US012722925B2

(12) United States Patent
Kayashima et al.

(10) Patent No.: US 12,722,925 B2
(45) Date of Patent: Sep. 1, 2026

(54) POST-PROCESSING DEVICE AND IMAGE FORMING APPARATUS

(71) Applicant: FUJIFILM Business Innovation Corp., Tokyo (JP)

(72) Inventors: Hideki Kayashima, Kanagawa (JP); Taku Kiyomasa, Kanagawa (JP); Takayuki Uchiyama, Kanagawa (JP); Takuya Makita, Kanagawa (JP); Takumi Uegane, Kanagawa (JP); Shota Saito, Kanagawa (JP); Kenya Sumida, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 327 days.

(21) Appl. No.: 18/356,342

(22) Filed: Jul. 21, 2023

(65) Prior Publication Data

US 2024/0239622 A1 Jul. 18, 2024

(30) Foreign Application Priority Data

Jan. 18, 2023 (JP) ..... 2023-006119

(51) Int. Cl.
*B65H 5/36* (2006.01)
*B65H 5/26* (2006.01)

(52) U.S. Cl.
CPC ..... *B65H 5/36* (2013.01); *B65H 5/26* (2013.01); *B65H 2404/741* (2013.01); *B65H 2513/42* (2013.01); *B65H 2801/27* (2013.01)

(58) Field of Classification Search
CPC ..... G03G 2215/00827; G03G 2215/00864; B65H 37/04; B65H 2513/42;
(Continued)

(56) References Cited

U.S. PATENT DOCUMENTS 6,164,511 A * 12/2000 Chung ..... B42C 1/12 227/111
9,932,193 B2 * 4/2018 Tomioka ..... B65H 29/58
(Continued)

FOREIGN PATENT DOCUMENTS

JP 2016-153040 A 8/2016
JP 2018-052641 A 4/2018
(Continued)

*Primary Examiner* — Leslie A Nicholson, III
(74) *Attorney, Agent, or Firm* — Oliff PLC

(57) ABSTRACT

A post-processing device includes: a unit that performs post-processing; a guide unit that guides the unit to a position at which the unit performs the post-processing, and has a first guide portion extending in a width direction of a medium, a second guide portion that is disposed at an end portion of the first guide portion, is inclined with respect to the width direction of the medium, and guides the unit to a corner of the medium, a third guide portion that is disposed at the end portion of the first guide portion and branches off from the second guide portion to extend, and a fourth guide portion that connects the second guide portion to the third guide portion; and a branching unit that is disposed at a portion at which the second guide portion and the third guide portion branch off from each other, guides the unit from the first guide portion toward the second guide portion, and guides the unit from the third guide portion toward the first guide portion.

15 Claims, 6 Drawing Sheets

(58) Field of Classification Search
CPC ..... B65H 2408/122; B65H 2408/1222; B65H 2801/27
USPC ..... 270/58.08
See application file for complete search history.

(56) References Cited

U.S. PATENT DOCUMENTS

| | | | | |
|---|---|---|---|---|
| 10,059,025 | B2 * | 8/2018 | Baek | B31F 5/001 |
| 10,087,034 | B2 * | 10/2018 | Awano | G03G 15/6544 |
| 10,934,124 | B2 * | 3/2021 | Baek | B27F 7/006 |
| 10,987,964 | B2 * | 4/2021 | Noguchi | B42C 1/12 |
| 11,279,587 | B2 * | 3/2022 | Noso | G03G 15/6541 |

FOREIGN PATENT DOCUMENTS

| | | | |
|---|---|---|---|
| JP | 2018-169510 | A | 11/2018 |
| JP | 2020-026111 | A | 2/2020 |
| JP | 2020-040786 | A | 3/2020 |

* cited by examiner

POST-PROCESSING DEVICE AND IMAGE FORMING APPARATUS

CROSS-REFERENCE TO RELATED APPLICATIONS

This application is based on and claims priority under 35 USC 119 from Japanese Patent Application No. 2023-006119 filed Jan. 18, 2023.

BACKGROUND

(i) Technical Field

The present invention relates to a post-processing device and an image forming apparatus including the post-processing device.

(ii) Related Art

Techniques described in JP2018-052641A, JP2020-040786A, and JP2020-026111A as below are known in the related art regarding a binding device that binds a bundle of media on which an image is recorded by an image recording device, a so-called stapler device.

JP2018-052641A describes a configuration in which a first binding unit (300) and a second binding unit (500) share a guide groove (350A) on a guide member (350), and in a case where the first binding unit (300) moves to a second binding position (P2), the second binding unit (500) is moved to a side of a movement path (R1) by a retreat mechanism (600).

JP2020-040786A describes a configuration in which a binding unit (101) that performs stapled binding is disposed on a front surface side of an apparatus, a binding unit (102) that performs staple-free binding is disposed on a back surface side of the apparatus, the binding unit (101) moves on rails (191, 192) to enable stapled parallel binding, so-called end binding, and the binding unit (102) rotates about an oscillating shaft (129) to be movable between a retreat position and a so-called corner binding position.

JP2020-026111A describes a configuration in which a stapled binding portion (90) and a staple-free binding portion (70) are movable in a common groove (521), and one of the stapled binding portion (90) and the staple-free binding portion (70) is movable to two binding positions (61A, 61B) or one binding position (62A, 62B) on the common groove (521). In the technique described in JP2020-026111A, a staple-free groove (525) on an extension of the common groove (521) and a staple groove (527) branching off from the staple-free groove (525) are provided, and the staple-free binding portion (70) is caused to retreat to the staple-free groove (525) in a case where the stapled binding portion (90) performs a binding process, while the stapled binding portion (90) is caused to retreat to the staple groove (527) in a case where the staple-free binding portion (70) performs a binding process.

SUMMARY

Aspects of non-limiting embodiments of the present disclosure relate to a post-processing device and an image forming apparatus that enable, in a case where movement from a position at which post-processing is performed to a standby position is performed, movement to the standby position without requiring one movement in a direction away from the standby position.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a post-processing device including: a unit that performs post-processing; a guide unit that guides the unit to a position at which the unit performs the post-processing, and has a first guide portion extending in a width direction of a medium, a second guide portion that is disposed at an end portion of the first guide portion, is inclined with respect to the width direction of the medium, and guides the unit to a corner of the medium, a third guide portion that is disposed at the end portion of the first guide portion and branches off from the second guide portion to extend, and a fourth guide portion that connects the second guide portion to the third guide portion; and a branching unit that is disposed at a portion at which the second guide portion and the third guide portion branch off from each other, guides the unit from the first guide portion toward the second guide portion, and guides the unit from the third guide portion toward the first guide portion.

BRIEF DESCRIPTION OF THE DRAWINGS

Exemplary embodiment(s) of the present invention will be described in detail based on the following figures, wherein:

FIGS. 4A and 4B are explanatory views of a stapling unit of Example 1, in which FIG. 4A is an explanatory view of a staple-free stapling unit, and FIG. 4B is an explanatory view of a stapled stapling unit;

FIGS. 5A to 5D are explanatory views of movement of the staple-free stapling unit of Example 1, in which FIG. 5A is an explanatory view of a state in which the staple-free stapling unit is moved to an end binding position, FIG. 5B is an explanatory view of a state in which the staple-free stapling unit is moved to a rear corner binding position, FIG. 5C is an explanatory view of a state in which the staple-free stapling unit is moved to a retreat position, and FIG. 5D is an explanatory view of a state in which the staple-free stapling unit is being moved forward from the retreat position; and FIGS. 6A to 6D are explanatory views of movement of a unit in a post-processing device including a staple-free binding unit and a stapled binding unit in the related art, in which FIG. 6A is an explanatory view of a state in which the two units are moved to retreat positions, FIG. 6B is an explanatory view of a state in which a staple-free stapler is moved forward, FIG. 6C is an explanatory view of a state in which a stapler rotating member is moved to a binding position, and FIG. 6D is an explanatory view of a state in which the staple-free stapler is moved to a rear corner binding position.

DETAILED DESCRIPTION

Figure 1:
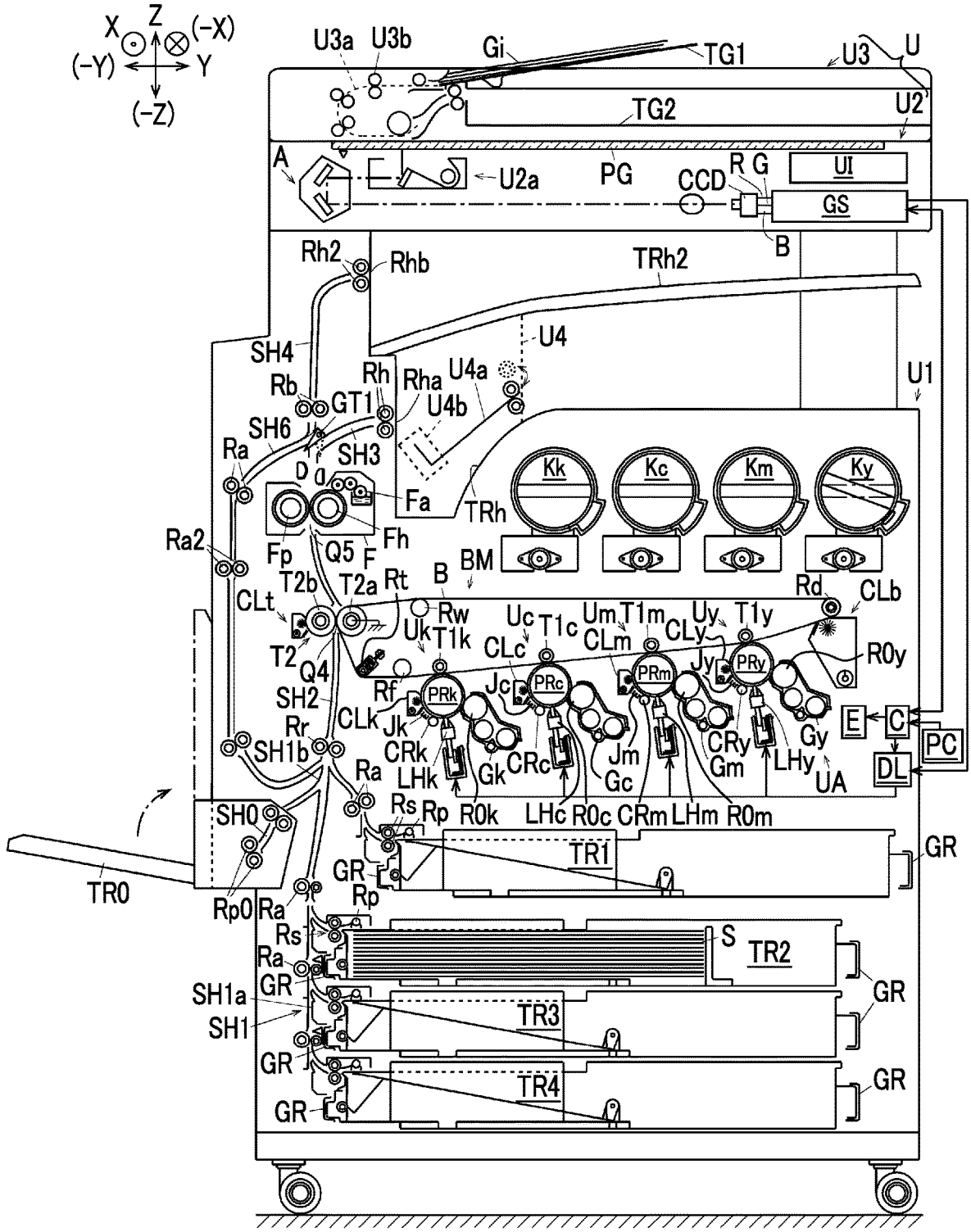
FIG. 1 is an overall explanatory view of an image forming apparatus of Example 1.

Next, examples as specific examples of an exemplary embodiment of the present invention will be described with reference to drawings, but the present invention is not limited to the following examples.

In addition, in order to facilitate the understanding of the following description, in the drawings, a front-rear direction is referred to as an X-axis direction, a right-left direction is referred to as a Y-axis direction, and an up-down direction is referred to as a Z-axis direction, directions or sides indicated by arrows X, −X, Y, −Y, Z, and −Z are respectively a front, rear, right, left, up, and down, or front side, rear side, right side, left side, upper side, and lower side.

Additionally, in the drawings, one in which "·" is described in "○" means an arrow pointing from the back to the front of the paper, and one in which "x" is described in "○" means an arrow pointing from the front to the back of the paper.

In addition, in the description using the following drawings, illustrations other than members necessary for the description are omitted as appropriate for the sake of easy understanding.

EXAMPLE 1

FIG. 1 is an overall explanatory view of an image forming apparatus of Example 1.

In FIG. 1, a copier U as an example of the image forming apparatus of Example 1 of the present invention has a printer section U1, which is an example of an image recording unit and is an example of an image recording device. A scanner section U2, which is an example of a reading unit and is an example of an image reading device, is supported above the printer section U1. An autofeeder U3 as an example of a document transporting device is supported above the scanner section U2.

A document tray TG1 as an example of a medium accommodating unit is disposed above the autofeeder U3. A plurality of documents Gi to be copied can be stacked and accommodated in the document tray TG1. Below the document tray TG1, a document discharge tray TG2 as an example of a document discharge unit is formed. A document transport roller U3*b* is disposed between the document tray TG1 and the document discharge tray TG2 along a document transport path U3*a*.

A platen glass PG as an example of a transparent platen is disposed on an upper surface of the scanner section U2. In the scanner section U2 of Example 1, a reading unit U2*a* as an example of a reading section is disposed below the platen glass PG. The reading unit U2*a* of Example 1 is supported to be movable in the right-left direction as an example of a sub-scanning direction, along a lower surface of the platen glass PG. The reading unit U2*a* is electrically connected to an image processing unit GS.

Figure 2:
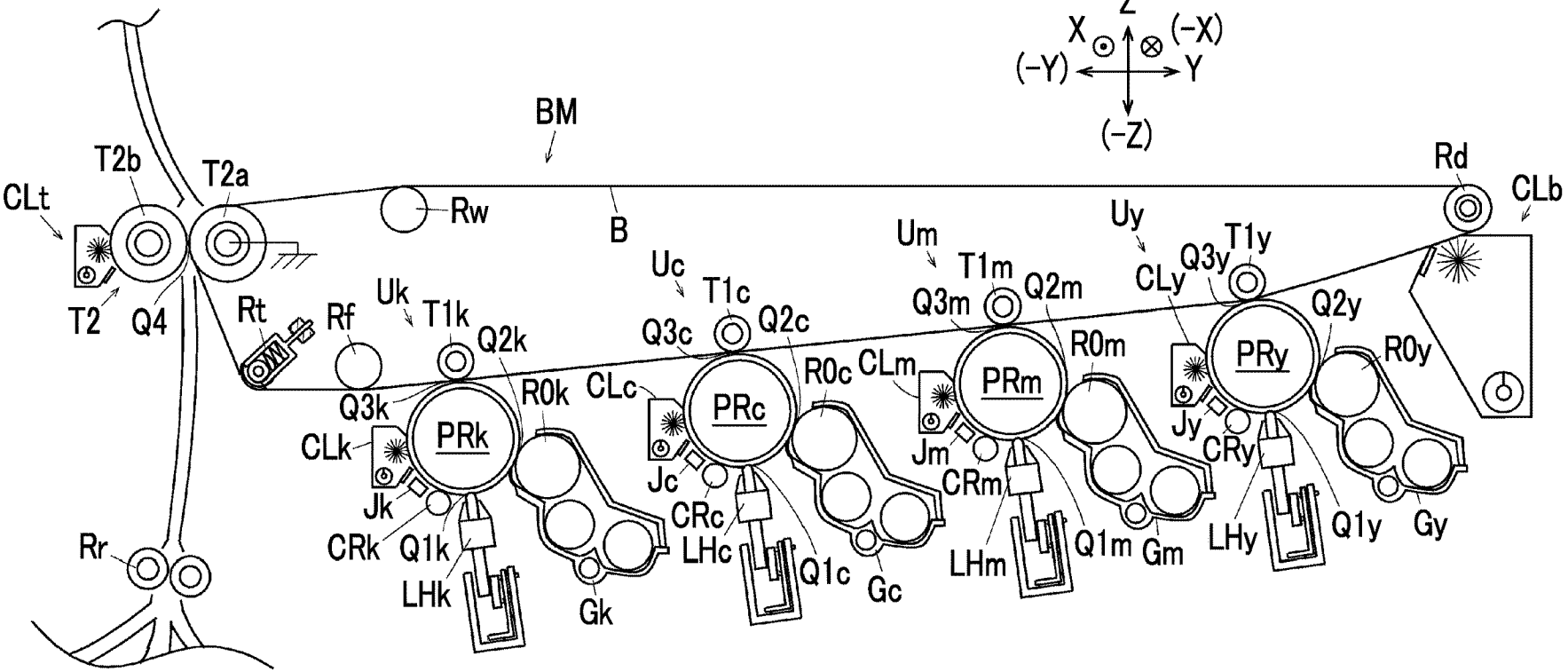
FIG. 2 is an explanatory view of a main portion of an image recording section of Example 1.

FIG. 2 is an explanatory view of a main portion of an image recording section of Example 1.

The image processing unit GS is electrically connected to a writing circuit DL of the printer section U1. The writing circuit DL is electrically connected to exposure devices LHy, LHm, LHc, and LHk as an example of a latent image forming unit.

As an example, the exposure devices LHy to LHk of Example 1 are configured by an LED head in which a plurality of LEDs are arranged in a main scanning direction. The exposure devices LHy to LHk are configured to output writing light beams corresponding to respective colors of Y, M, C, and K according to a signal input from the writing circuit DL.

In the writing circuit DL and a power supply circuit E, a writing timing and a power supply timing are controlled in accordance with a control signal from a control section C as an example of a control unit.

In FIG. 1, photoreceptors PRy, PRm, PRc, and PRk as an example of an image holding unit are disposed above the exposure devices LHy to LHk. In FIGS. 1 and 2, writing regions Q1*y*, Q1*m*, Q1*c*, and Q1*k* are configured by regions in which the photoreceptors PRy to PRk are irradiated with the writing light beams.

Charging rollers CRy, CRm, CRc, and CRk as an example of a charging unit are disposed upstream of the writing regions Q1*y* to Q1*k* in respective rotation directions of the photoreceptors PRy to PRk. The charging rollers CRy to CRk of Example 1 come into contact with the photoreceptors PRy to PRk and are supported to be rotatable therealong.

Developing devices Gy, Gm, Gc, and Gk as an example of a developing unit are disposed downstream of the writing regions Q1*y* to Q1*k* in the rotation directions of the photoreceptors PRy to PRk. Development regions Q2*y*, Q2*m*, Q2*c*, and Q2*k* are configured by regions in which the photoreceptors PRy to PRk and the developing devices Gy to Gk respectively face each other.

Primary transfer rollers T1*y*, T1*m*, T1*c*, and T1*k* as an example of a primary transfer unit are disposed downstream of the developing devices Gy to Gk in the rotation directions of the photoreceptors PRy to PRk. Primary transfer regions Q3*y*, Q3*m*, Q3*c*, and Q3*k* are configured by regions in which the photoreceptors PRy to PRk and the primary transfer rollers T1*y* to T1*k* respectively face each other.

Photoreceptor cleaners CLy, CLm, CLc, and CLk as an example of a cleaning unit are disposed downstream of the primary transfer rollers T1*y* to T1*k* in the rotation directions of the photoreceptors PRy to PRk.

Static eliminators Jy, Jm, Jc, and Jk, which are an example of a static elimination unit and are an example of a static elimination device, are disposed downstream of the photoreceptor cleaners CLy to CLk in the rotation directions of the photoreceptors PRy to PRk.

The Y-color photoreceptor PRy, the charging roller CRy, the exposure device LHy, the developing device Gy, the primary transfer roller T1*y*, the photoreceptor cleaner CLy, and the static eliminator Jy constitute a Y-color image forming unit Uy as an example of a Y-color visible image forming unit of Example 1 for forming a Y-color toner image. Similarly, the photoreceptors PRm, PRc, and PRk, the charging rollers CRm, CRc, and CRk, the exposure devices LHm, LHc, and LHk, the developing devices Gm, Gc, and Gk, the primary transfer rollers T1*m*, T1*c*, and T1*k*, the photoreceptor cleaners CLm, CLc, and CLk, and the static eliminators Jm, Jc, and Jk constitute M-, C-, and K-color image forming units Um, Uc, and Uk.

A belt module BM as an example of an intermediate transfer device is disposed above the photoreceptors PRy to PRk. The belt module BM has an intermediate transfer belt B, which is an example of an image holding unit and is an example of an intermediate transfer unit. The intermediate transfer belt B is formed of an endless band-shaped member.

The intermediate transfer belt B of Example 1 is supported to be rotatable by a tension roller Rt as an example of a tensioning unit, a walking roller Rw as an example of a deviation correction unit, an idler roller Rf as an example of a driven unit, a back-up roller T2*a* as an example of a unit facing a secondary transfer region, the primary transfer rollers T1*y* to T1*k*, and a drive roller Rd as an example of a drive member. In Example 1, the intermediate transfer belt B rotates in a case where a drive force is transmitted to the drive roller Rd.

A secondary transfer roller T2*b* as an example of a secondary transfer unit is disposed at a position facing the back-up roller T2*a* with the intermediate transfer belt B interposed therebetween. The back-up roller T2*a*, the secondary transfer roller T2*b*, and the like constitute a secondary transfer device T2 of Example 1 as an example of a transfer device. A secondary transfer region Q4 is configured by a region in which the secondary transfer roller T2*b* comes into contact with the intermediate transfer belt B.

A belt cleaner CLb as an example of a cleaning device for an intermediate transfer body is disposed downstream of the secondary transfer region Q4 in a rotation direction of the intermediate transfer belt B.

A transfer device T1+T2+B of Example 1 as an example of a transfer unit is constituted by the primary transfer rollers T1*y* to T1*k*, the intermediate transfer belt B, the secondary transfer device T2, and the like. In addition, an image recording section Uy to Uk+T1+T2+B of Example 1 is constituted by the image forming units Uy to Uk and the transfer device T1+T2+B.

In FIG. 1, a pair of right and left guide rails GR as an example of a guide unit are provided in four stages below the image forming units Uy to Uk. The guide rails GR respectively support paper feed trays TR1, TR2, TR3, and TR4 as an example of a medium accommodating unit so as to enter and exit in the front-rear direction. Recording sheets S as an example of a medium are accommodated in the paper feed trays TR1 to TR4.

A pick-up roller Rp as an example of a taking-out unit is disposed on an upper left side of each of the paper feed trays TR1 to TR4. A separating roller Rs as an example of a separating unit is disposed downstream of the pick-up roller Rp in a transport direction of the recording sheet S. A paper feed path SH1 extending upward as an example of a medium transport path is formed downstream of the separating roller Rs in the transport direction of the recording sheet S. A plurality of transport rollers Ra as an example of a transporting unit are disposed on the paper feed path SH1.

A manual tray TR0 as an example of a medium accommodating unit is disposed at a lower left portion of the copier U. A pick-up roller Rp0 is disposed at an upper right portion of the manual tray TR0, and a manual paper feed path SH0 extends. The manual paper feed path SH0 joins the paper feed path SH1.

On the paper feed path SH1, a registration roller Rr as an example of a transport timing adjusting unit is disposed upstream of the secondary transfer region Q4. A transport path SH2 extends from the registration roller Rr toward the secondary transfer region Q4.

A fixing device F as an example of a fixing unit is disposed downstream of the secondary transfer region Q4 in the transport direction of the recording sheet S. The fixing device F has a heating roller Fh as an example of a fixing member for heating and a pressing roller Fp as an example of a fixing member for pressing. A fixing region Q5 is configured by a contact region between the heating roller Fh and the pressing roller Fp.

A lower paper discharge tray TRh as an example of a medium discharge unit is formed on an upper surface of the printer section U1. In Example 1, a finisher U4 as an example of a post-processing device is provided in the lower paper discharge tray TRh. Above the fixing device F, a paper discharge path SH3 as an example of a transport path extends toward the lower paper discharge tray TRh. A paper discharge roller Rh as an example of a medium transporting unit is disposed at a downstream end of the paper discharge path SH3.

An upper paper discharge tray TRh2 as an example of the medium discharge unit is disposed above the lower paper discharge tray TRh. An upper transport path SH4 that branches off from the paper discharge path SH3 and extends toward the upper paper discharge tray TRh2 is formed above the fixing device F.

On the upper transport path SH4, a reversing roller Rb that can rotate in forward and reverse directions as an example of the medium transporting unit is disposed. Above a branch position between the paper discharge path SH3 and the upper transport path SH4, a reversing path SH6 as an example of the medium transport path branches to a lower left side from the upper transport path SH4.

A gate GT1 as an example of a switching unit is disposed across a branch portion between the paper discharge path SH3 and the upper transport path SH4 and a branch portion between the upper transport path SH4 and the reversing path SH6. The gate GT1 guides the recording sheet S from the fixing device F toward the lower paper discharge tray TRh, and is supported to switch between a first guide position (second position) at which the recording sheet S is guided from the upper transport path SH4 to the reversing path SH6 and a second guide position (first position) at which the recording sheet S is guided from the fixing device F to the upper transport path SH4.

On the reversing path SH6, a plurality of transport rollers Ra as an example of the medium transporting unit are disposed. A downstream end of the reversing path SH6 joins the paper feed path SH1 upstream of the registration roller Rr.

Description of Image Forming Operation

In the copier U of Example 1 having the above configuration, in a case where the document Gi is manually placed on the platen glass PG by a worker and copied, the reading unit U2*a* moves in the right-left direction from an initial position and the document Gi on the platen glass PG is scanned while being exposed. In a case where the document Gi is automatically transported by the autofeeder U3 and copied, the plurality of documents Gi accommodated in the document tray TG1 are sequentially transported and passed to a document reading position on the platen glass PG and discharged to the document discharge tray TG2. The documents Gi that sequentially pass through the reading position on the platen glass PG are exposed to the reading unit U2*a* and scanned. Reflected light from the document Gi is received by the reading unit U2*a*. The reading unit U2*a* converts the received reflected light of the document Gi into an electrical signal. In a case where both sides of the document Gi are read, the document Gi is also read by a reading sensor.

The electrical signal output from the reading unit U2*a* is input to the image processing unit GS. The image processing unit GS converts the electrical signal of R, G, and B color images read by the reading unit U2*a* into yellow (Y), magenta (M), cyan (C), and black (K) image information for forming a latent image. The image processing unit GS outputs the converted image information to the writing circuit DL of the printer section U1. In a case where the image is a monochromatic image, so-called monochrome, the image processing unit GS outputs image information of only black K to the writing circuit DL.

The writing circuit DL outputs a control signal corresponding to the input image information to the exposure devices LHy to LHk. The exposure devices LHy to LHk output the writing light beams corresponding to the control signal.

Each of the photoreceptors PRy to PRk is rotatably driven as image formation is started. A charging voltage is applied to the charging rollers CRy to CRk from the power supply circuit E. Therefore, surfaces of the photoreceptors PRy to PRk are charged by the charging rollers CRy to CRk. Electrostatic latent images are formed on the surfaces of the charged photoreceptors PRy to PRk in the writing regions Q1*y* to Q1*k* by the exposure devices LHy to LHk. The electrostatic latent images of the photoreceptors PRy to PRk are developed into toner images as an example of a visible image by the developing devices Gy to Gk in the development regions Q2*y* to Q2*k*.

The developed toner images are transported to the primary transfer regions Q3*y* to Q3*k* that come into contact with the intermediate transfer belt B as an example of the intermediate transfer body. In the primary transfer regions Q3*y* to Q3*k*, a primary transfer voltage having a polarity opposite to the charging polarity of the toner is applied to the primary transfer rollers T1*y* to T1*k* from the power supply circuit E. Therefore, the respective toner images on the photoreceptors PRy to PRk are transferred to the intermediate transfer belt B by the primary transfer rollers T1*y* to T1*k*. In a case of multi-color toner images, a toner image on a downstream side is transferred by being superimposed on a toner image transferred to the intermediate transfer belt B in the primary transfer region on an upstream side.

Residues and deposits of the photoreceptors PRy to PRk after the primary transfer are cleaned by the photoreceptor cleaners CLy to CLk. The surfaces of the photoreceptors PRy to PRk after cleaning are subjected to static elimination by the static eliminators Jy to Jk. The surfaces of the photoreceptors PRy to PRk after static elimination are re-charged by the charging rollers CRy to CRk.

The monochromatic or multi-color toner images transferred onto the intermediate transfer belt B by the primary transfer rollers T1*y* to T1*k* in the primary transfer regions Q3*y* to Q3*k* are transported to the secondary transfer region Q4.

The recording sheet S on which an image is to be recorded is taken out by the pick-up rollers Rp of the paper feed trays TR1 to TR4 used. In a case where a plurality of recording sheets S are stacked and taken out, the recording sheets S taken out by the pick-up roller Rp are separated one by one by the separating roller Rs. The recording sheet S separated by the separating roller Rs is transported to the paper feed path SH1 by the transport roller Ra. The recording sheet S transported to the paper feed path SH1 is sent to the registration roller Rr. The recording sheet S loaded on the manual tray TR0 is also sent to the paper feed path SH1 through the manual paper feed path SH0 by the pick-up roller Rp0.

The registration roller Rr transports the recording sheet S to the secondary transfer region Q4 in accordance with a timing at which the toner image formed on the intermediate transfer belt B is transported to the secondary transfer region Q4. A secondary transfer voltage having a polarity opposite to the charging polarity of the toner is applied to the secondary transfer roller T2*b* by the power supply circuit E. Therefore, the toner image on the intermediate transfer belt B is transferred from the intermediate transfer belt B to the recording sheet S.

After the secondary transfer, deposits and the like adhering to a surface of the intermediate transfer belt B are cleaned by the belt cleaner CLb.

The recording sheet S on which the toner image is secondarily transferred is heated and fixed while being passed through the fixing region Q5.

In a case where post-processing is performed, the recording sheet S on which the image is fixed is transported to the finisher U4 as the example of the post-processing device provided in the lower paper discharge tray TRh. In a case where the recording sheet S is not subjected to the post-processing, the recording sheet S is transported to the upper paper discharge tray TRh2. In a case where the recording sheet S is transported to the lower paper discharge tray TRh, the gate GT1 moves to the first guide position. Therefore, the recording sheet S sent out from the fixing device F is transported to the paper discharge path SH3. The recording sheet S transported to the paper discharge path SH3 is transported toward the finisher U4 and the lower paper discharge tray TRh by the paper discharge roller Rh.

The finisher U4 performs a binding process as an example of post-processing on the recording sheet S, and then discharges the recording sheet S to the lower paper discharge tray TRh.

In a case where the recording sheet S is discharged to the upper paper discharge tray TRh2, the gate GT1 moves to the second guide position and the recording sheet S is discharged to the upper paper discharge tray TRh2.

In a case where the recording sheet S is subjected to two-sided printing, the gate GT1 moves to the second guide position. Then, in a case where a rear end of the recording sheet S passes through the gate GT1, the gate GT1 moves to the first guide position and the reversing roller Rb rotates in the reverse direction. Therefore, the recording sheet S is guided by the gate GT1 and sent to the reversing path SH6. The recording sheet S transported to the reversing path SH6 is sent to the registration roller Rr in a state where front and back sides are reversed.

Description of Finisher U4

In FIG. 1, the finisher U4 of Example 1 has a compile tray U4*a* as an example of a loading unit. A stapling device U4*b* as an example of a binding device is disposed upstream of the compile tray U4*a* in a medium transport direction.

The lower paper discharge tray TRh is disposed downstream of the compile tray U4*a* in the medium transport direction.

Figure 3:
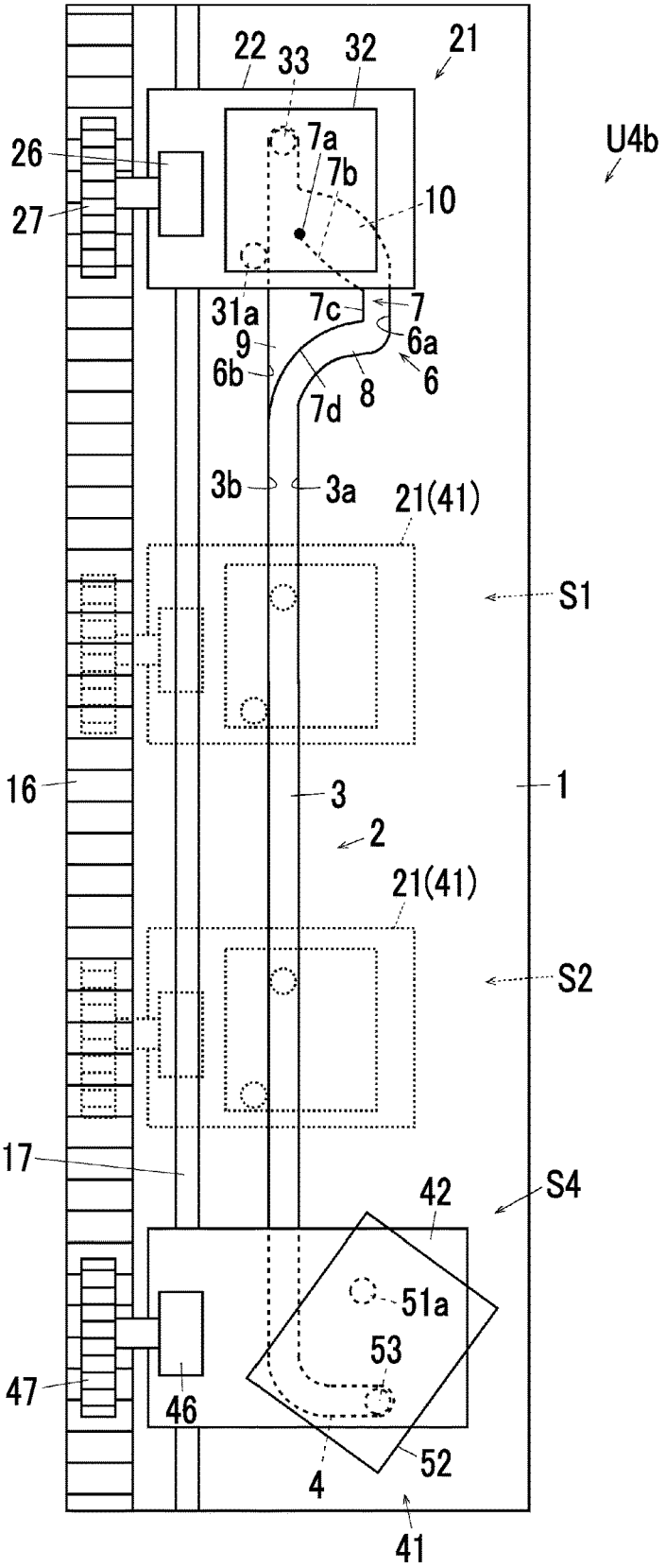
FIG. 3 is a plan view of a post-processing device of Example 1.

FIG. 3 is a plan view of the post-processing device of Example 1.

In FIG. 3, the stapling device U4*b* of Example 1 has a guide plate 1 as an example of a guide member. In Example 1, the guide plate 1 is disposed such that a left side thereof is lower in the direction of gravity than a right side thereof, which is a compile tray U4*a* side, as a whole. That is, the guide plate 1 is inclined in a lower left direction. In order to align end edges of the recording sheets S loaded on the compile tray U4*a*, it is desirable that the compile tray U4*a* is inclined in the lower left direction, and the guide plate 1 is also inclined in the lower left direction, but the guide plate 1 is not limited thereto. The guide plate 1 may be disposed horizontally, or may be configured to be inclined in a lower right direction.

The guide plate 1 is formed with a guide groove 2 as an example of a guide unit. The guide groove 2 of Example 1 has an end binding guide portion 3 extending in the front-rear direction, which is an example of a first guide portion and is an example of a common guide portion. A front corner binding guide portion 4 as an example of a fifth guide portion is connected to a front end of the end binding guide portion 3. The front corner binding guide portion 4 is formed in a shape that is inclined and curved in an arc shape to the right.

At a rear end portion of the end binding guide portion 3, a protruding portion 6 that protrudes toward a right side of an extension of the end binding guide portion 3, that is, toward an inside of the compile tray U4*a* is formed. A branch gate 7 as an example of a branching unit is disposed inside the protruding portion 6. The branch gate 7 is supported by the guide plate 1 at a fulcrum portion 7*a* at a rear end of the branch gate 7. The branch gate 7 has a rear portion 7*b* extending toward a front right side from the fulcrum portion 7*a*, a middle portion 7*c* extending forward from a front end of the rear portion 7*b*, and a front portion 7*d* extending toward a front left side from a front end of the middle portion 7*c*.

In the branch gate 7 of Example 1, the rear portion 7*b*, the middle portion 7*c*, and the front portion 7*d* are configured as one plate-shaped member, and are formed in a so-called leaf spring shape as an example of a biasing unit. Therefore, the branch gate 7 is configured to be elastically deformable.

The rear portion 7*b* and the middle portion 7*c* of the branch gate 7 are disposed at a distance from a right wall 6*a* of the protruding portion 6. The front portion 7*d* of the branch gate 7 is disposed at a distance from the right wall 6*a* of the protruding portion 6, and a front end of the front portion 7*d* is disposed in contact with a left wall 6*b* of the protruding portion 6, that is, a wall surface on an extension of a left wall 3*b* of the end binding guide portion 3.

Therefore, a space between the front portion 7*d* of the branch gate 7 and the right wall 6*a* of the protruding portion 6 constitutes a rear corner binding guide portion 8 as an example of a second guide portion. In addition, a space between the branch gate 7 and the left wall 6*b* of the protruding portion 6 constitutes a retreat portion 9 on the extension of the end binding guide portion 3 as an example of a third guide portion. Furthermore, a space between the middle portion 7*c* and the rear portion 7*b* of the branch gate 7 and the right wall 6*a* of the protruding portion 6 constitutes a retreat connection portion 10 as an example of a fourth guide portion that connects the rear corner binding guide portion 8 to the retreat portion 9.

The guide groove 2 of Example 1 is constituted by the end binding guide portion 3, the front corner binding guide portion 4, the rear corner binding guide portion 8, the retreat portion 9, and the retreat connection portion 10.

Rack teeth 16 as an example of a drive unit are disposed at a left end portion of the guide plate 1. The rack teeth 16 of Example 1 have a plate shape extending in the front-rear direction, that is, a medium width direction, and a gear is formed on an upper surface thereof.

A guide shaft 17 as an example of a guide unit is supported between the rack teeth 16 and the guide groove 2. The guide shaft 17 is formed in a rod shape extending in the medium width direction.

Figure 4A:
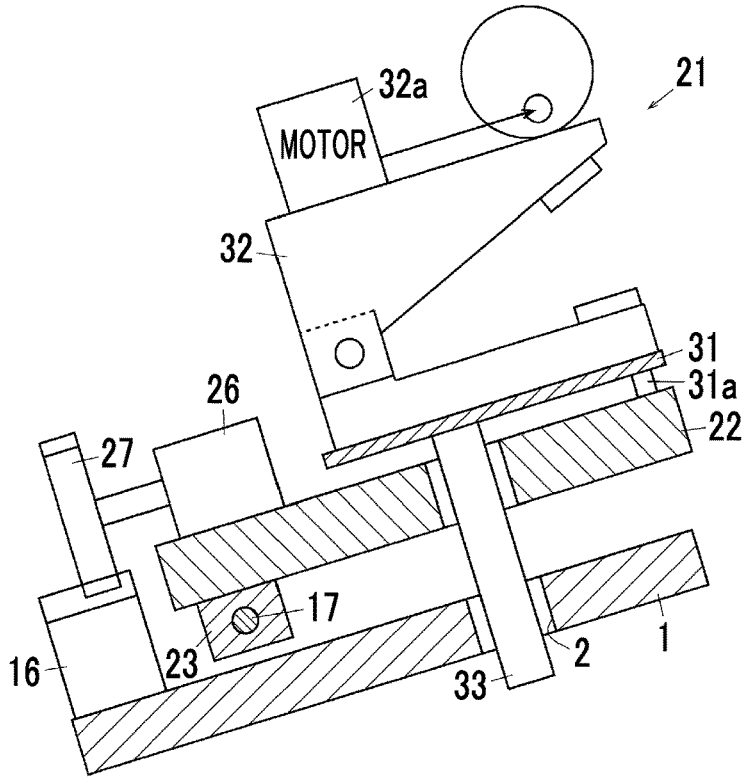
Figure 4B:
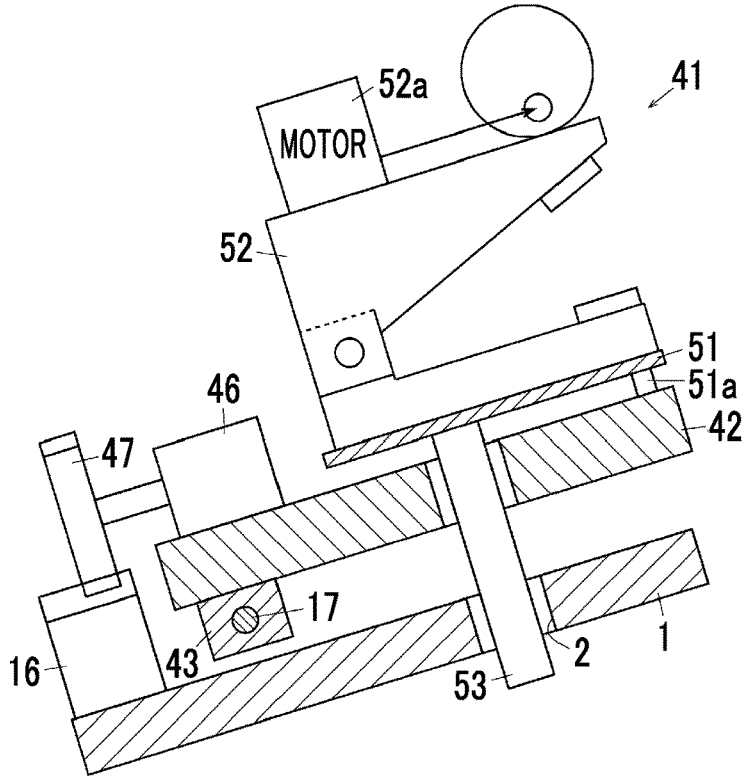

FIGS. 4A and 4B are explanatory views of a stapling unit of Example 1, in which FIG. 4A is an explanatory view of a staple-free stapling unit, and FIG. 4B is an explanatory view of a stapled stapling unit.

In FIG. 3, a staple-free stapling unit 21 as an example of a first unit is disposed above the guide plate 1.

In FIGS. 3 and 4A, the staple-free stapling unit 21 has a first carriage portion 22 as an example of a first moving unit. The first carriage portion 22 is provided with a first guided portion 23 as an example of a first guided unit. The guide shaft 17 passes through the first guided portion 23. Therefore, the first guided portion 23 can move along the guide shaft 17, and the first carriage portion 22 can move in the front-rear direction, that is, in the medium width direction along the guide shaft 17.

A first moving motor 26 as an example of a drive source for movement is supported on a left portion of the first carriage portion 22. A first drive gear 27 as an example of a gear, to which a drive force is transmitted from the first moving motor 26, meshes with the rack teeth 16. Therefore, in response to forward rotation, reverse rotation, and stop of the first moving motor 26, the first carriage portion 22 can move in the front-rear direction along the guide plate, and stop at end binding positions S1 and S2 and a rear corner binding position S3.

A first moving mechanism 16 to 26 of Example 1 is constituted by the rack teeth 16, the guide shaft 17, the first guided portion 23, the first moving motor 26, and the like.

A first rotary base 31 as an example of a first inclined unit is disposed above the first carriage portion 22. The first rotary base 31 is supported to be rotatable relative to the first carriage portion 22 about a first rotary shaft 31*a*. A staple-free stapler 32 as an example of a first binding unit is supported on an upper portion of the first rotary base 31. The staple-free stapler 32 clamps the recording sheets S and binds a bundle of the recording sheets S without using a staple in response to an operation of a first operation motor 32*a* as an example of a drive source for operation. As a method of binding the recording sheets S without a staple, any known method in the related art can be adopted. A method of tearing a part of the paper can also be adopted, and a method of applying a pressure in a thickness direction of the paper to entangle fibers or a method of deforming the paper can also be adopted.

Figure 5A:
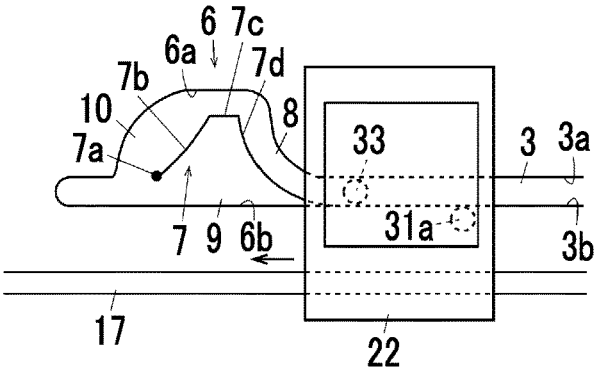
Figure 5B:
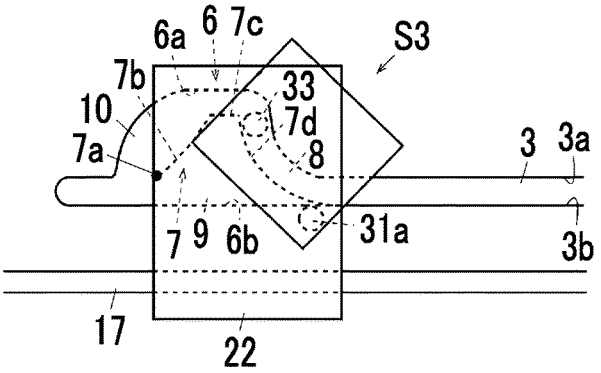
Figure 5C:
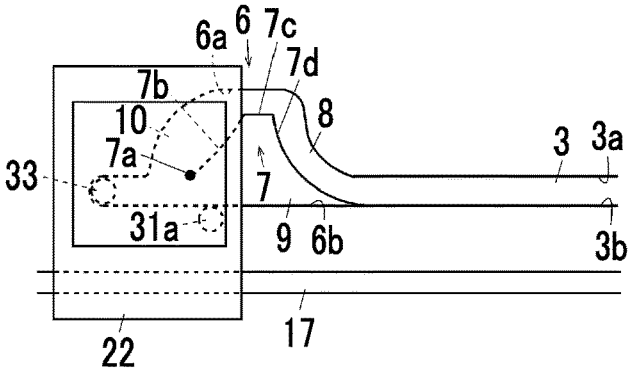
Figure 5D:
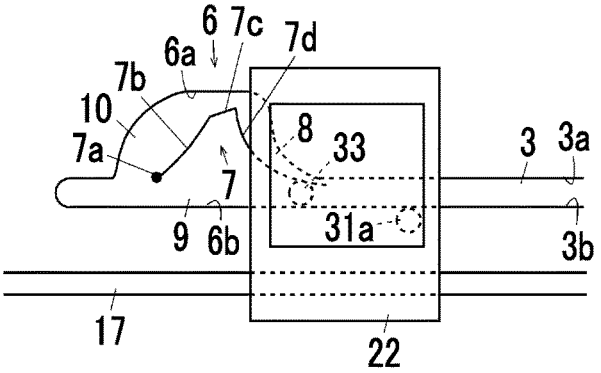

FIGS. 5A to 5D are explanatory views of the movement of the staple-free stapling unit of Example 1, in which FIG. 5A is an explanatory view of a state in which the staple-free stapling unit is moved to the end binding position, FIG. 5B is an explanatory view of a state in which the staple-free stapling unit is moved to the rear corner binding position, FIG. 5C is an explanatory view of a state in which the staple-free stapling unit is moved to a retreat position, and FIG. 5D is an explanatory view of a state in which the staple-free stapling unit is being moved forward from the retreat position.

In FIGS. 4A to 5D, a first inclined guide shaft 33 as an example of a first inclined guide unit is supported at a lower portion the first rotary base 31. The first inclined guide shaft 33 passes through the first carriage portion 22 and fits into the guide groove 2.

In Example 1, the staple-free stapling unit 21 is inclined in the lower left direction as a whole, in response to an inclination of the guide plate 1. Therefore, the first inclined guide shaft 33 is disposed in a state in which the first inclined guide shaft 33 is more likely to come into contact with the left walls 3*b* and 6*b* and the branch gate 7 than the right walls 3*a* and 6*a* of the guide groove 2 due to a self-weight of the staple-free stapling unit 21.

In FIG. 5A, in a state where the first inclined guide shaft 33 is fitted into the end binding guide portion 3, the staple-free stapler 32 is in a state shown by the broken line in FIG. 3 and thus can perform binding at a binding angle parallel to the end edge of the recording sheets S.

In FIG. 5B, in a case where the first inclined guide shaft 33 enters the rear corner binding guide portion 8, the first inclined guide shaft 33 is guided along the rear corner binding guide portion 8, and the first rotary base 31 and the staple-free stapler 32 rotate from the state shown in FIG. 5A to the state shown in FIG. 5B. Therefore, binding at a binding angle inclined with respect to the end edge of the recording sheets S.

In FIG. 5C, in a case where the first carriage portion 22 moves rearward from the state of FIG. 5B, the first inclined guide shaft 33 is guided by the retreat connection portion 10 and reaches the retreat portion 9. Therefore, as shown in FIG. 5C, the first rotary base 31 and the staple-free stapler 32 rotate from the state shown in FIG. 5B to the state shown in FIG. 5C. In Example 1, in a case where a staple-free binding process is not performed, the staple-free stapling unit 21 retreats to the retreat position shown in FIG. 5C and stands by.

In the retreat position shown in FIG. 5C, the first inclined guide shaft 33 comes into contact with the left wall 6*b*, and the first rotary base 31 and the staple-free stapler 32 enter a state of not being inclined with respect to the paper width direction. In a state where the staple-free stapler 32 or the like is inclined, interference or collision may occur in a case where a stapled stapling unit 41, which will be described later, moves rearward to the end binding position S1. However, in Example 1, since the staple-free stapler 32 or the like returns to the state of not being inclined, interference and collision are suppressed.

In FIG. 5D, in a case where the staple-free stapling unit 21 performs end binding or rear corner binding, the staple-free stapling unit 21 moves forward from the retreat position of FIG. 5C. Meanwhile, the first inclined guide shaft 33 of the staple-free stapling unit 21 comes into contact with the front portion 7*d* of the branch gate 7 and elastically deforms the branch gate 7 in such a manner that the branch gate 7 is pushed away. Therefore, the staple-free stapling unit 21 moves forward from the retreat position.

In FIG. 3, the stapled stapling unit 41 as an example of a second unit is disposed forward of the staple-free stapling unit 21.

In FIGS. 3 and 4B, similar to the first carriage portion 22, the first guided portion 23, the first moving motor 26, the first drive gear 27, the first rotary base 31, and the first inclined guide shaft 33 of the staple-free stapling unit 21, the stapled stapling unit 41 has a second carriage portion 42, a second guided portion 43, a second moving motor 46, a second drive gear 47, a second rotary base 51, and a first inclined guide shaft 53. Therefore, in the stapled stapling unit 41 of Example 1, in response to forward rotation, reverse rotation, and stop of the second moving motor 46, the second carriage portion 42 can move in the front-rear direction along the guide plate, and stop at the end binding positions S1 and S2 and a front corner binding position S4.

The stapled stapling unit 41 of Example 1 has a stapler 52 as an example of a second binding unit instead of the staple-free stapler 32 of the staple-free stapling unit 21. The stapler 52 binds the recording sheets S by driving a staple into the recording sheets S in response to an operation of a second operation motor 52*a* as an example of a drive source for operation. Therefore, the stapled stapling unit 41 of Example 1 can perform post-processing different from the post-processing of the staple-free stapling unit 21.

In FIG. 3, in a state where the second inclined guide shaft 53 is fitted into the end binding guide portion 3, the stapler 52 can perform binding at a binding angle parallel to the end edge of the recording sheets S as shown by the broken lines of the end binding positions S1 and S2 of FIG. 3.

In a case where the second inclined guide shaft 53 enters the front corner binding guide portion 4, the second inclined guide shaft 53 is guided along the front corner binding guide portion 4, and the second rotary base 51 and the stapler 52 rotate from the state indicated by the broken lines in FIG. 3 to the state indicated by the solid line in FIG. 3. Therefore, at the front corner binding position S4, binding can be performed at a binding angle inclined with respect to the end edge of the recording sheets S.

In Example 1, in a case where the stapled stapling unit 41 does not perform a stapled binding process, the stapled stapling unit 41 retreats to the front corner binding position S4 shown in FIG. 3 and stands by. Therefore, in Example 1, the front corner binding position S4 is also used as a retreat position of the stapled stapling unit 41 to be shared. In Example 1, even in a case where the stapled stapling unit 41 is replenished with staples, a door of a front surface (not shown) of the finisher U4 is opened at the front corner binding position S4, and the staples are replenished. Therefore, the front corner binding position S4 is also used as a staple replenishment position to be shared. In Example 1, the front corner binding position S4, the retreat position, and the staple replenishment position are common, but are not limited thereto. The retreat position and the staple replenishment position can be set to a position different from the front corner binding position S4, the front corner binding position S4 and the retreat position can be set to be common and only the staple replenishment position can be set to be different, the front corner binding position S4 and the staple replenishment position can be set to be common and only the retreat position can be set to be different, or the staple replenishment position and the retreat position can be set to be common and only the front corner binding position can be set to be different. In this manner, the front corner binding position S4, the retreat position, and the staple replenishment position can be changed as appropriate.

Furthermore, in Example 1, the retreat positions of the staple-free stapling unit 21 and the stapled stapling unit 41 are divided into opposite sides, that is, a back side and a front side. In a case of setting the retreat positions on the same side, it is necessary to secure a space so that the retreat positions do not overlap, or it is necessary to lengthen the guide groove connected to the retreat positions. As described above, there is a problem that the entire apparatus tends to become larger in size. Contrary to this, in Example 1, an increase in size of the entire apparatus is suppressed compared to the case where the retreat positions are set on the same side.

Action of Example 1

In the copier U of Example 1 having the above configuration, in a case where staple-free binding is set for the bundle of recording sheets S loaded on the compile tray U4*a*, the staple-free stapling unit 21 is moved to the end binding positions S1 and S2 or the rear corner binding position S3 according to the setting of end binding or corner binding and the staple-free binding is performed. In a case where stapled binding is set, the stapled stapling unit 41 is moved to the end binding positions S1 and S2 or the front corner binding position S4 according to the setting of end binding or corner binding, and the stapled binding is performed.

Figure 6A:
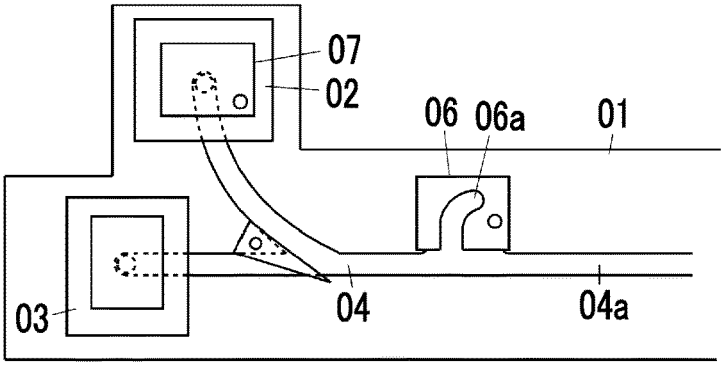
Figure 6B:
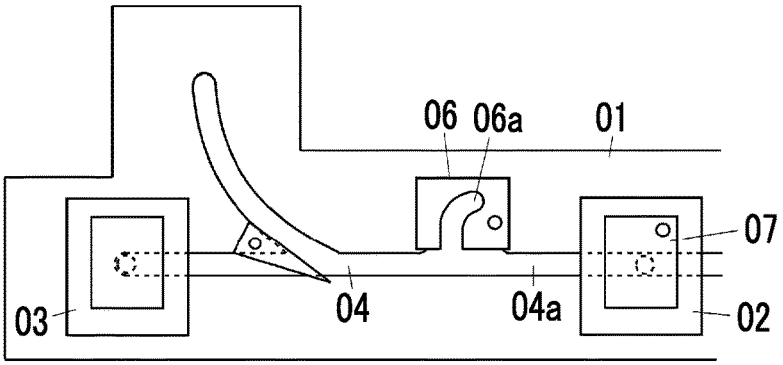
Figure 6C:
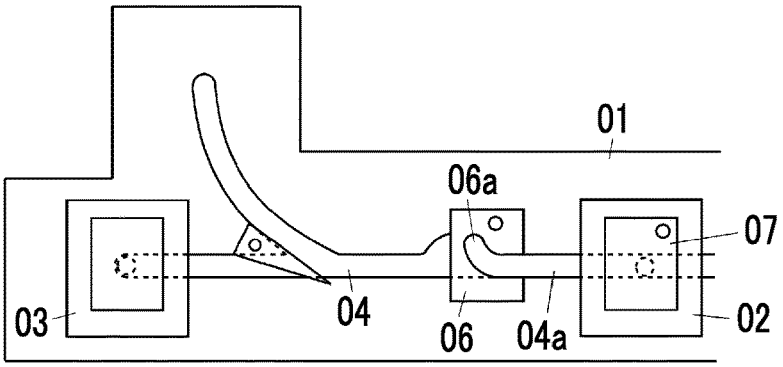
Figure 6D:
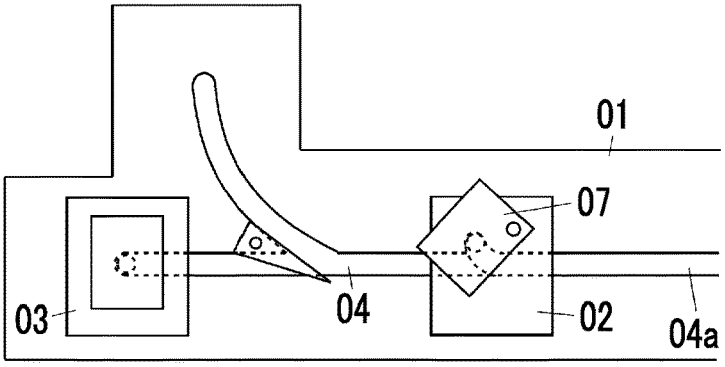

FIGS. 6A to 6D are explanatory views of movement of a unit in a post-processing device including a staple-free binding unit and a stapled binding unit in the related art, in which FIG. 6A is an explanatory view of a state in which the two units are moved to retreat positions, FIG. 6B is an explanatory view of a state in which a staple-free stapler is moved forward, FIG. 6C is an explanatory view of a state in which a stapler rotating member is moved to a binding position, and FIG. 6D is an explanatory view of a state in which the staple-free stapler is moved to a rear corner binding position.

In FIGS. 6A to 6D, in the post-processing device in the related art such as JP2020-026111A, in a configuration in which a staple-free binding unit 02 and a stapled binding unit 03 are disposed on a rear side of the apparatus on a guide plate 01, in order to enable rear corner binding, a stapler rotating member 06 that can enter and exit a guide groove 04 is necessary. For example, in a case where the staple-free binding unit 02 performs rear corner binding, the staple-free binding unit 02 once passes through the rear corner binding position as shown in FIGS. 6A and 6B, and moves to an end binding guide portion 04*a* of the guide groove 04. Then, as shown in FIG. 6C, the stapler rotating member 06 having a groove portion 06*a* corresponding to a binding angle is moved from a rotation retreat position to the binding position. Then, as shown in FIG. 6D, as the stapled binding unit 03 is moved to the rear corner binding position, an inclined guide shaft (not shown) is guided to the groove portion 06*a*, and a staple-free stapler 07 rotates. In a case of moving from the position shown in FIG. 6D to the retreat position, the staple-free binding unit 02 is moved forward from the position shown in FIG. 6D, the stapler rotating member 06 is then moved to the rotation retreat position, and the staple-free binding unit 02 is then moved rearward to the retreat position.

In the configuration shown in FIGS. 6A to 6D, in a case where a binding process is performed at the rear corner binding position, in a case where the units 02 and 03 are allowed to retreat from the rear corner binding position, the units 02 and 03 need to be moved once forward, that is, in a direction away from the retreat position, so that there is a problem that a retreat operation takes time.

Contrary to this, in Example 1, only by moving the staple-free stapling unit 21 rearward after the process is completed at the rear corner binding position S3, the staple-free stapling unit 21 can be moved to the retreat position shown in FIG. 5C through the state of FIG. 5B. Therefore, in a case of moving from the rear corner binding position, at which the post-processing is performed, to the retreat position where the unit stands by as shown in FIGS. 6A to 6D, the staple-free stapling unit 21 can be moved to the retreat position without being moved once in a direction away from the retreat position. Therefore, a time required for the process can be shortened.

In addition, in a configuration having a retreat mechanism for moving a second binding unit to a side of a movement path as in the technique described in JP2018-052641A, it is necessary to secure a space for the retreat mechanism, so that an increase in size is likely to be incurred. In addition, a cost of the retreat mechanism is likely to increase. Contrary to this, in Example 1, the retreat mechanism is not necessary, so that a smaller size and a lower cost than in JP2018-052641A are easily achieved.

In the technique described in JP2020-040786A, there is a problem that corner stapled binding cannot be performed, but Example 1 can cope with the problem.

In addition, in Example 1, in a case where the staple-free stapling unit 21 moves rearward from the end binding positions S1 and S2 and the like, the staple-free stapling unit 21 is guided toward the rear corner binding guide portion 8 by the branch gate 7, and in a case where the staple-free stapling unit 21 moves forward from the retreat position, the staple-free stapling unit 21 moves in a form of pushing and elastically deforming the front portion 7*d* of the branch gate 7. Therefore, in Example 1, a movement direction of the staple-free stapling unit 21 can be guided by the leaf spring-shaped branch gate 7, and it is not necessary to use a drive source such as a motor or a solenoid for driving the gate. Therefore, an overall manufacturing cost and maintenance cost of the finisher U4 are suppressed.

In particular, in Example 1, the branch gate 7 is biased to a position (first branch position) guided toward the rear corner binding guide portion 8 by an elastic force of the leaf spring. In a case where the staple-free stapling unit 21 moves forward from the retreat position, the branch gate 7 is pushed by the first inclined guide shaft 33 of the staple-free stapling unit 21 and moves to a second branch position.

In addition, in Example 1, the staple-free stapling unit 21 is disposed in a state of being inclined in the lower left direction. Therefore, the self-weight of the staple-free stapling unit 21 acts in a direction in which the first inclined guide shaft 33 is pressed against the branch gate 7. Therefore, the staple-free stapling unit 21 is likely to be reliably guided along the branch gate 7 compared to a configuration in which the staple-free stapling unit 21 is in a horizontal state or is inclined in a lower right direction.

MODIFICATION EXAMPLES

Although the example of the present invention has been described in detail above, the present invention is not limited to the above example, and various changes can be made within the scope of the gist of the present invention described in the claims. Modification Examples (H01) to (H07) of the present invention are illustrated below.

(H01) In the example, the copier U has been described as an example of the image forming apparatus. However, the present invention is not limited thereto, and the image forming apparatus can also be configured by, for example, a printer, a fax machine, or a multifunction machine having a plurality of functions thereof or all of the functions thereof. In addition, the present invention is not limited to an electrophotographic image forming apparatus, and can also be applied to any image forming apparatus such as an inkjet type image forming apparatus or a heat transfer printing type image forming apparatus.

(H02) In the example, the configuration in which the developing agents of four colors are used in the copier U has been described. However, the present invention is not limited thereto and for example, the present invention can also be applied to a monochromatic image forming apparatus or a multi-color image forming apparatus in which three or less colors or five or more colors are used.

(H03) In the example, the endless band-shaped intermediate transfer belt B has been described as an example of the image holding unit. However, the present invention is not limited thereto. For example, the present invention can also be applied to a cylindrical intermediate transfer drum, a photoreceptor drum, and a photoreceptor belt. In addition, the present invention can also be applied to a configuration in which no intermediate transfer body is provided and an image from a photoreceptor is directly recorded on the recording sheet S.

(H04) In the example, the configuration in which the staple-free stapling unit 21 and the stapled stapling unit 41 are provided as the unit for performing post-processing has been described, but the present invention is not limited thereto. For example, the present invention can also be applied to a configuration in which only one stapling unit is disposed on the guide plate 1. In addition, the present invention can also be applied to a configuration having three or more stapling units. Furthermore, the present invention is not limited to the stapling unit, and the present invention can also be applied to a punching unit for forming a punched hole, a unit for forming a folded line, a unit for forming a perforated line, and the like.

(H05) In the example, the configuration in which the finisher U4 is provided on the lower paper discharge tray TRh has been described, but the present invention is not limited thereto. A post-processing device externally attached to a side portion of the copier U may also be used.

(H06) In the example, the configuration in which the rotary bases 31 and 51 are rotated relative to the carriage portions 22 and 42 has been described, but the present invention is not limited thereto. For example, the present invention can be applied to any form such as a configuration in which the rotary bases 31 and 51 slide with respect to the carriage portions 22 and 42, and a form in which rotation and sliding are combined for movement.

(H07) In the example, the branch gate 7 has a leaf spring-shaped form, but the present invention is not limited thereto. For example, the branch gate 7 is not configured with a leaf spring and is configured to hardly undergo elastic deformation and to be rotatable about a rotary shaft, or can be configured to be switched between guiding directions by using a drive source such as a motor or a solenoid. At this time, the branch gate can be configured to be biased toward the first branch position by a biasing member such as a coil spring or a torsion spring.

SUPPLEMENTARY NOTES (((1)))

A post-processing device comprising:

a unit that performs post-processing;

a guide unit that guides the unit to a position at which the unit performs the post-processing, and has a first guide portion extending in a width direction of a medium, a second guide portion that is disposed at an end portion of the first guide portion, is inclined with respect to the width direction of the medium, and guides the unit to a corner of the medium, a third guide portion that is disposed at the end portion of the first guide portion and branches off from the second guide portion to extend, and a fourth guide portion that connects the second guide portion to the third guide portion; and a branching unit that is disposed at a portion at which the second guide portion and the third guide portion branch off from each other, guides the unit from the first guide portion toward the second guide portion, and guides the unit from the third guide portion toward the first guide portion.

(((2)))

The post-processing device according to (((1))), wherein the branching unit is movable about a support portion between a first branch position at which the unit is guided from the first guide portion toward the second guide portion and a second branch position at which the unit is guided from the third guide portion toward the first guide portion.

(((3)))

The post-processing device according to (((2))), further comprising:

a biasing unit that biases the branching unit toward the first branch position.

(((4)))

The post-processing device according to (((3))), wherein the unit is disposed to be inclined with respect to a horizontal direction such that a self-weight of the unit acts in a direction in which the unit is pressed against the branching unit moved to the first branch position.

(((5)))

The post-processing device according to any one of (((1))) to (((4))), further comprising:

a second unit that performs post-processing different from the post-processing of the unit, and is movable in the width direction of the medium by being guided by the first guide portion.

(((6)))

The post-processing device according to (((5))), further comprising:

a fifth guide portion that is disposed at an end portion of the first guide portion on a side opposite to the second guide portion, is inclined with respect to the width direction of the medium to guide the unit to an opposite corner of the medium, and allows the second unit to stand by during the post-processing of the unit.

(((7)))

A post-processing device comprising:

a unit that performs post-processing;

a guide unit that guides the unit to a position at which the unit performs the post-processing, and has a first guide portion extending in a width direction of a medium, a second guide portion that is disposed at an end portion of the first guide portion, is inclined with respect to the width direction of the medium, and guides the unit to a corner of the medium, a third guide portion that is disposed at the end portion of the first guide portion and branches off from the second guide portion to extend, and a fourth guide portion that connects the second guide portion to the third guide portion; and a branching unit that is disposed at a portion at which the second guide portion and the third guide portion branch off from each other, and is movable between a first branch position at which the unit is guided from the first guide portion toward the second guide portion and a second branch position at which the unit is guided from the third guide portion toward the first guide portion.

(((8)))

An image forming apparatus comprising:

an image recording device that records an image on a medium; and the post-processing device according to any one of (((1))) to (((7))), which performs post-processing on the medium on which the image is recorded by the image recording device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a unit that performs post-processing;

a guide unit that guides the unit to a position at which the unit performs the post-processing, and has a first guide portion extending in a width direction of a medium, a second guide portion that is disposed at an end portion of the first guide portion, is inclined with respect to the width direction of the medium, and guides the unit to a corner of the medium, a third guide portion that is disposed at the end portion of the first guide portion and branches off from the second guide portion to extend, and a fourth guide portion that connects the second guide portion to the third guide portion; and a branching unit that is disposed at a portion at which the second guide portion and the third guide portion branch off from each other, guides the unit from the first guide portion toward the second guide portion, and guides the unit from the third guide portion toward the first guide portion, wherein the branching unit is elastically biased toward a branch position that guides the unit from the first guide portion toward the second guide portion, and wherein, during movement of the unit from a standby position toward a post-processing position, the unit directly contacts and elastically deforms the branching unit to permit the unit to pass the branching unit and enter the first guide portion without using a motor or solenoid.

2. The post-processing device according to claim 1, wherein the branching unit is movable about a support portion between a first branch position at which the unit is guided from the first guide portion toward the second guide portion and a second branch position at which the unit is guided from the third guide portion toward the first guide portion.

3. The post-processing device according to claim 2, further comprising:

a biasing unit that elastically biases the branching unit toward the first branch position.

4. The post-processing device according to claim 3, wherein the unit is disposed to be inclined with respect to a horizontal direction such that a self-weight of the unit acts in a direction in which the unit is pressed against the branching unit moved to the first branch position.

5. The post-processing device according to claim 1, further comprising:

a second unit that performs post-processing different from the post-processing of the unit, and is movable in the width direction of the medium by being guided by the first guide portion.

6. The post-processing device according to claim 5, further comprising:

a fifth guide portion that is disposed at an end portion of the first guide portion on a side opposite to the second guide portion, is inclined with respect to the width direction of the medium to guide the unit to an opposite corner of the medium, and allows the second unit to stand by during the post-processing of the unit.

7. A post-processing device comprising:

a unit that performs post-processing;

a guide unit that guides the unit to a position at which the unit performs the post-processing, and has a first guide portion extending in a width direction of a medium, a second guide portion that is disposed at an end portion of the first guide portion, is inclined with respect to the width direction of the medium, and guides the unit to a corner of the medium, a third guide portion that is disposed at the end portion of the first guide portion and branches off from the second guide portion to extend, and a fourth guide portion that connects the second guide portion to the third guide portion; and a branching unit that is disposed at a portion at which the second guide portion and the third guide portion branch off from each other, and is movable between a first branch position at which the unit is guided from the first guide portion toward the second guide portion and a second branch position at which the unit is guided from the third guide portion toward the first guide portion, wherein the branching unit is elastically biased toward a branch position that guides the unit from the first guide portion toward the second guide portion, and wherein, during movement of the unit from a standby position toward a post-processing position, the unit directly contacts and elastically deforms the branching unit to permit the unit to pass the branching unit and enter the first guide portion without using a motor or solenoid.

8. An image forming apparatus comprising:

an image recording device that records an image on a medium; and the post-processing device according to claim 1 that performs post-processing on the medium on which the image is recorded by the image recording device.

9. An image forming apparatus comprising:

an image recording device that records an image on a medium; and the post-processing device according to claim 2 that performs post-processing on the medium on which the image is recorded by the image recording device.

10. An image forming apparatus comprising:

an image recording device that records an image on a medium; and the post-processing device according to claim 3 that performs post-processing on the medium on which the image is recorded by the image recording device.

11. An image forming apparatus comprising:

an image recording device that records an image on a medium; and the post-processing device according to claim 4 that performs post-processing on the medium on which the image is recorded by the image recording device.

12. An image forming apparatus comprising:

an image recording device that records an image on a medium; and the post-processing device according to claim 5 that performs post-processing on the medium on which the image is recorded by the image recording device.

13. An image forming apparatus comprising:

an image recording device that records an image on a medium; and the post-processing device according to claim 6 that performs post-processing on the medium on which the image is recorded by the image recording device.

14. An image forming apparatus comprising:

an image recording device that records an image on a medium; and the post-processing device according to claim 7 that performs post-processing on the medium on which the image is recorded by the image recording device.

15. A post-processing device comprising:

a unit that performs post-processing;

guiding means for guiding the unit to a position at which the unit performs the post-processing, the guiding means having a first guide portion extending in a width direction of a medium, a second guide portion that is disposed at an end portion of the first guide portion, is inclined with respect to the width direction of the medium, and guides the unit to a corner of the medium, a third guide portion that is disposed at the end portion of the first guide portion and branches off from the second guide portion to extend, and a fourth guide portion that connects the second guide portion to the third guide portion; and branching means for guiding the unit from the first guide portion toward the second guide portion, and guiding the unit from the third guide portion toward the first guide portion, the branching means being disposed at a portion at which the second guide portion and the third guide portion branch off from each other, wherein the branching means is elastically biased toward a branch position that guides the unit from the first guide portion toward the second guide portion, and wherein, during movement of the unit from a standby position toward a post-processing position, the unit directly contacts and elastically deforms the branching means to permit the unit to pass the branching means and enter the first guide portion without using a motor or solenoid.

* * * * *